US007779794B2

(12) United States Patent
Nakamura et al.

(10) Patent No.: US 7,779,794 B2
(45) Date of Patent: Aug. 24, 2010

(54) BREATHER DEVICE AND ENGINE

(75) Inventors: Hideto Nakamura, Shizuoka (JP); Toshio Hayashi, Shizuoka (JP)

(73) Assignee: Suzuki Motor Corporation, Shizuoka (JP)

( * ) Notice: Subject to any disclaimer, the term of this patent is extended or adjusted under 35 U.S.C. 154(b) by 0 days.

(21) Appl. No.: 12/176,627

(22) Filed: Jul. 21, 2008

(65) Prior Publication Data

US 2009/0025663 A1 Jan. 29, 2009

(30) Foreign Application Priority Data

Jul. 26, 2007 (JP) ..... 2007-194088

(51) Int. Cl.
*F01M 13/00* (2006.01)

(52) U.S. Cl. ..... 123/41.86; 123/572; 123/573; 123/574

(58) Field of Classification Search ..... 123/41.86, 123/572–574, 196 P, 196 CP, 196 R, 195 AC
See application file for complete search history.

(56) References Cited

U.S. PATENT DOCUMENTS

| | | | | |
|---|---|---|---|---|
| 5,542,402 | A * | 8/1996 | Lee et al. | 123/573 |
| 6,065,458 | A * | 5/2000 | Ozeki | 123/572 |
| 6,142,129 | A * | 11/2000 | Hori et al. | 123/572 |
| 6,234,154 | B1 * | 5/2001 | Spix | 123/572 |
| 6,508,238 | B2 * | 1/2003 | Furuya | 123/572 |
| 7,047,955 | B2 * | 5/2006 | Ookawa et al. | 123/572 |
| 7,055,509 | B2 * | 6/2006 | Hara | 123/572 |
| 2002/0081918 | A1 | 6/2002 | Mineno et al. | |
| 2002/0179356 | A1 | 12/2002 | Morii et al. | |
| 2003/0062209 | A1 | 4/2003 | Iyoda et al. | |
| 2003/0118260 | A1 | 6/2003 | Suzuki | |
| 2003/0213637 | A1 | 11/2003 | Moriyama | |
| 2004/0118370 | A1 | 6/2004 | Ohsawa | |
| 2004/0182623 | A1 | 9/2004 | Morii et al. | |
| 2005/0205334 | A1 | 9/2005 | Moriyama | |
| 2007/0062500 | A1 * | 3/2007 | Arima et al. | 123/572 |

FOREIGN PATENT DOCUMENTS

| | | |
|---|---|---|
| JP | 63-7221 | 3/1988 |
| JP | 2002-339718 | 11/2002 |
| JP | 2002-364468 | 12/2002 |

OTHER PUBLICATIONS

English language Abstract of JP 2002-364468, Dec. 18, 2002.
English language Abstract of JP 2002-339718, Nov. 27, 2002.
U.S. Appl. No. 12/175,656 to Nakamura et al., filed Jul. 18, 2008.

* cited by examiner

*Primary Examiner*—Michael Cuff
*Assistant Examiner*—Hung Q Nguyen
(74) *Attorney, Agent, or Firm*—Stein McEwen, LLP

(57) ABSTRACT

A breather device provided in a 4-cycle engine which is configured to be mounted on a front part of a vehicle body of a snow vehicle, the 4-cycle engine including a crankcase, a crankshaft rotatably supported on the crankcase and provided in a state substantially parallel to the snow vehicle width direction, and a magnet unit connected to one end of the crankshaft, wherein the breather device includes a breather chamber integrally provided on a lateral side of the 4-cycle engine at the same side of the magnet unit and the breather chamber is disposed above the magnet unit in a side view.

2 Claims, 8 Drawing Sheets

BREATHER DEVICE AND ENGINE

This application claims priority from Japanese Patent Application No. 2007-194088 filed Jul. 26, 2007, the entire contents of which are herein incorporated by reference.

BACKGROUND

The present invention relates to a breather device and an engine, particularly, to breather device provided in a 4-cycle engine which is configured to be mounted in a snow vehicle.

Generally, in a front part of a vehicle body of a snow vehicle, such as a snowmobile, an engine is mounted in an engine room covered with an engine mount frame, and as this engine, a 4-cycle engine prevails to meet the requirements, such as emission control and an improvement in fuel efficiency, against recent environmental problems.

It is necessary to provide this type of engine with a breather device as a means for releasing the pressure of blow-by gas within a crankcase to the outside and for separating atomized oil mixed into the blow-by gas from the gas.

As a breather device of a snow vehicle, on which the 4-cycle engine is mounted, for example, one (for example, refer to Patent Documents 1 or 2) in which a breather chamber is provided by creating a space in an upper part within a cylinder head cover of an engine and providing a partition plate in the space, one in which a breather tank is installed separately from an engine, and the breather tank is connected to the engine through a hose are suggested (For example, refer to Patent Document 3)

Patent Document 1: Japanese Utility Model Publication No. 63-7221 A

Patent Document 2: Japanese Patent Publication No. 2002-364468 A

Patent Document 3: Japanese Patent Publication No. 2002-339718A

However, in the breather device of an engine described in Patent the Patent Document 1 or 2, since the breather chamber is provided in an upper part within the cylinder head cover, the total height of the engine becomes high. Accordingly, the size of the engine becomes large.

On the other hand, in the breather device described in the Patent Document 3, the number of parts, such as the breather tank and the hose, is increased, and it is necessary to create an installation space for the breather tank and the hose. As a result, an engine hood becomes large. Further, the water in the breather tank might be frozen because the breather tank or the hose are cooled down by the wind during traveling.

SUMMARY

It is therefore an object of the invention to provide a breather device capable of achieving downsizing of the engine, and at the same time, sufficiently securing the volume of a breather chamber.

According to an aspect of an exemplary embodiment of the present invention, there is provided a breather device provided in a 4-cycle engine which is configured to be mounted on a front part of a vehicle body of a snow vehicle, the breather device comprising: a breather chamber integrally provided on the lateral side of the engine.

With the above configuration, the breather chamber is disposed in a dead space on the lateral side of the engine. Since the dead space can be effectively used, the total height of the engine can be suppressed low, and the downsizing of the engine can be achieved.

The engine may include a crankcase, a cylinder block coupled to an upper part of the crankcase, and a cylinder head coupled to an upper part of the cylinder block; a magnet unit may be provided on the lateral side of the crankcase; and the breather chamber may be provided above the magnet unit.

The engine may include a crankcase, a cylinder block coupled to an upper part of the crankcase, and a cylinder head coupled to an upper part of the cylinder block; a cam driving mechanism chamber may be provided on the lateral side of the engine; and the breather chamber may be provided on the lateral side of the cam driving mechanism chamber.

The breather chamber may include an upper part monolithically integrated with the cylinder head, and a lower part monolithically integrated with the cylinder block; and the breather chamber may be formed by coupling the cylinder head with the cylinder block.

The breather chamber may include an upper part monolithically integrated with the cylinder head, and a lower part monolithically integrated with the cylinder block; the upper part of the breather chamber may be partitioned into two chambers by a rib extending in a vertical direction; one of the chambers may be provided with a communication passage communicating with the cam driving mechanism chamber; and another of the chambers is provided with a breather outlet.

The communication passage may include an upper vertical passage communicated with the breather chamber, a lower vertical passage communicated with the cam driving mechanism chamber, and a transverse passage connecting the upper vertical passage with the lower vertical passage, thereby being formed into a crank shape.

Since the breather chamber is formed by coupling the upper part monolithically integrated with the cylinder head and the lower part monolithically integrated with the cylinder block, it is possible to reduce the number of parts and to streamline an assembling process of the breather chamber. At the same time, the volume of the breather chamber can be sufficiently secured.

Since the communication passage is formed between the breather chamber and the cam driving mechanism chamber, even if the snow vehicle is overturned, most of oil flows toward the cylinder head, and hardly flows into the breather chamber. Moreover, even if oil flows into the breather chamber, since the breather chamber is partitioned into two chambers by the rib, there is no fear that the oil leaks from the breather outlet.

Since the breather chamber is disposed on the lateral side of the engine, the breather chamber is warmed by the heat transfer from the cylinder head or the cylinder block, there is no fear that the moisture inside the breather chamber is cooled down and frozen by the wind during traveling. Accordingly, the reliability of the breather device can be enhanced.

According to another aspect of an exemplary embodiment of the present invention, there is provided an engine which is configured to be mounted on a vehicle, the engine comprising: a crank case; a cylinder block disposed above the crank case; and a cylinder head disposed above the cylinder block, wherein the cylinder block and the cylinder head are provided with a breather device including a breather chamber.

The cylinder block may be monolithically formed with an upper part of the breather chamber; and the cylinder head may be monolithically formed with a lower part of the breather chamber.

BRIEF DESCRIPTION OF THE DRAWINGS

The above and other aspects of the present invention will become more apparent by describing in detail exemplary embodiments thereof with reference to the accompanying drawings, wherein.

DETAILED DESCRIPTION OF EXEMPLARY EMBODIMENTS

Hereinafter, an embodiment of the invention will be explained with reference to the drawings.

Figure 1:
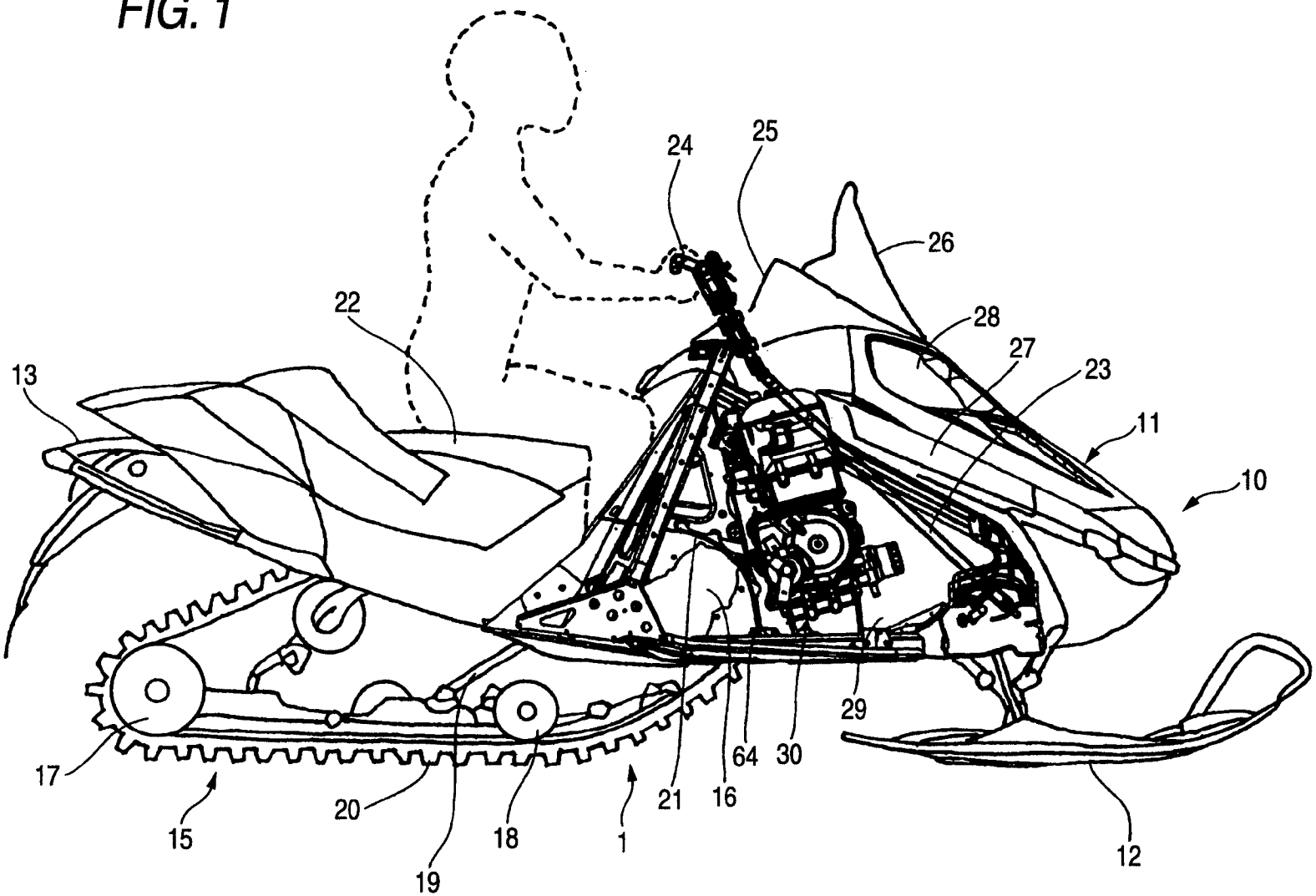
FIG. 1 is a side view showing a snow vehicle on which an engine according to an embodiment of the invention is mounted.
Figure 2:
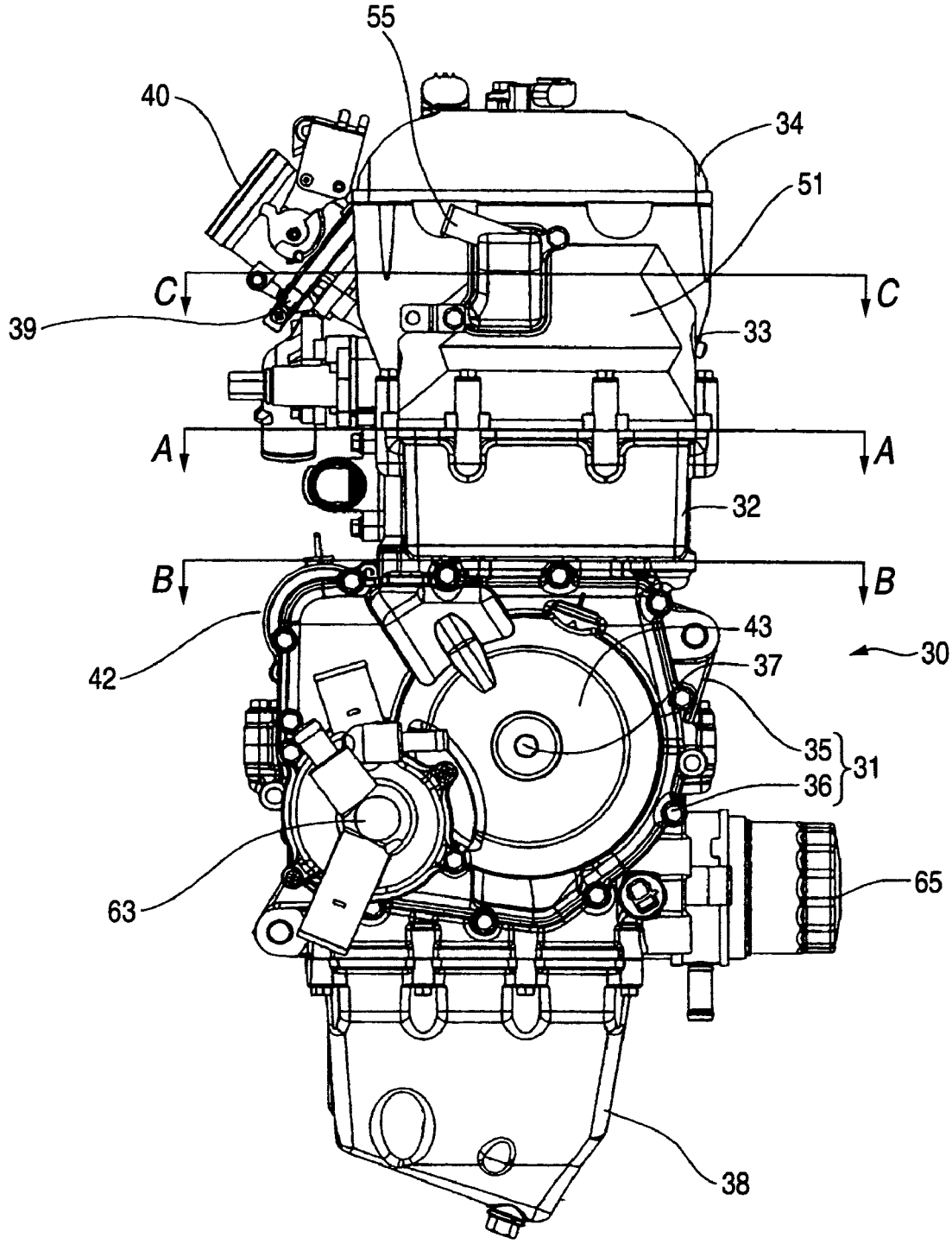
FIG. 2 is a side view showing the engine according to the embodiment.
Figure 3:
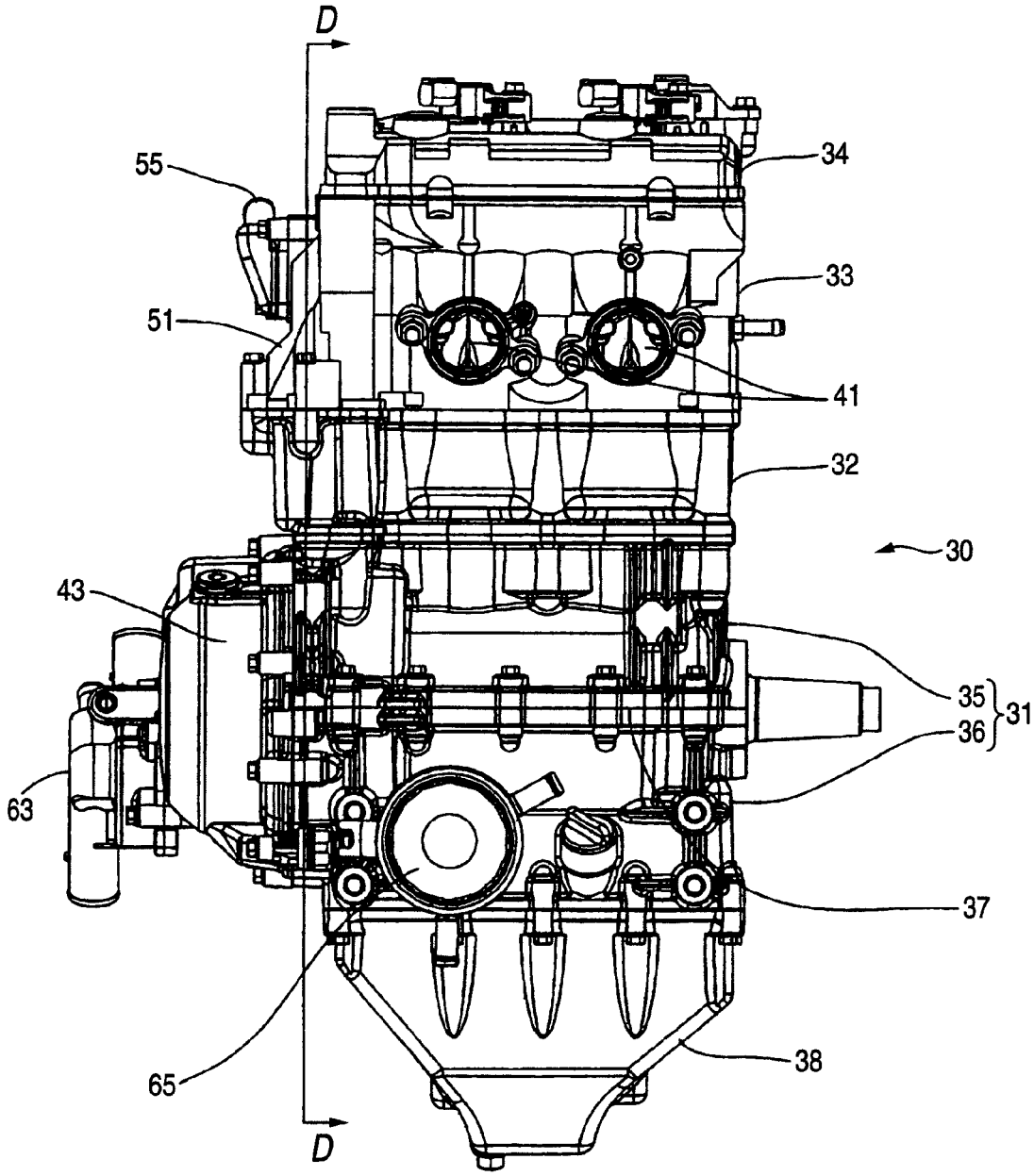
FIG. 3 is a front view showing the engine according to the embodiment.
Figure 4:
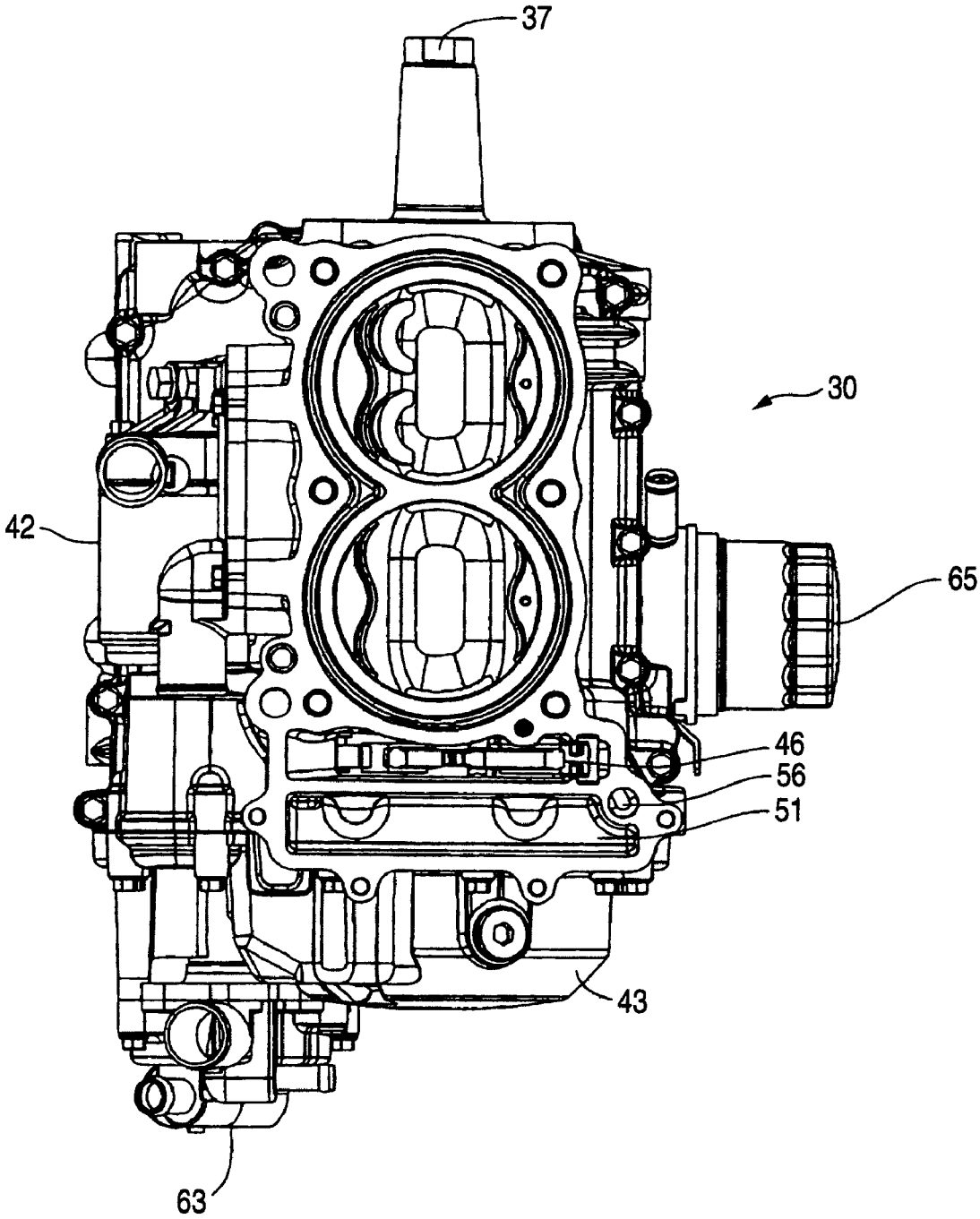
FIG. 4 is a sectional view taken along a line A-A of FIG. 2.
Figure 5:
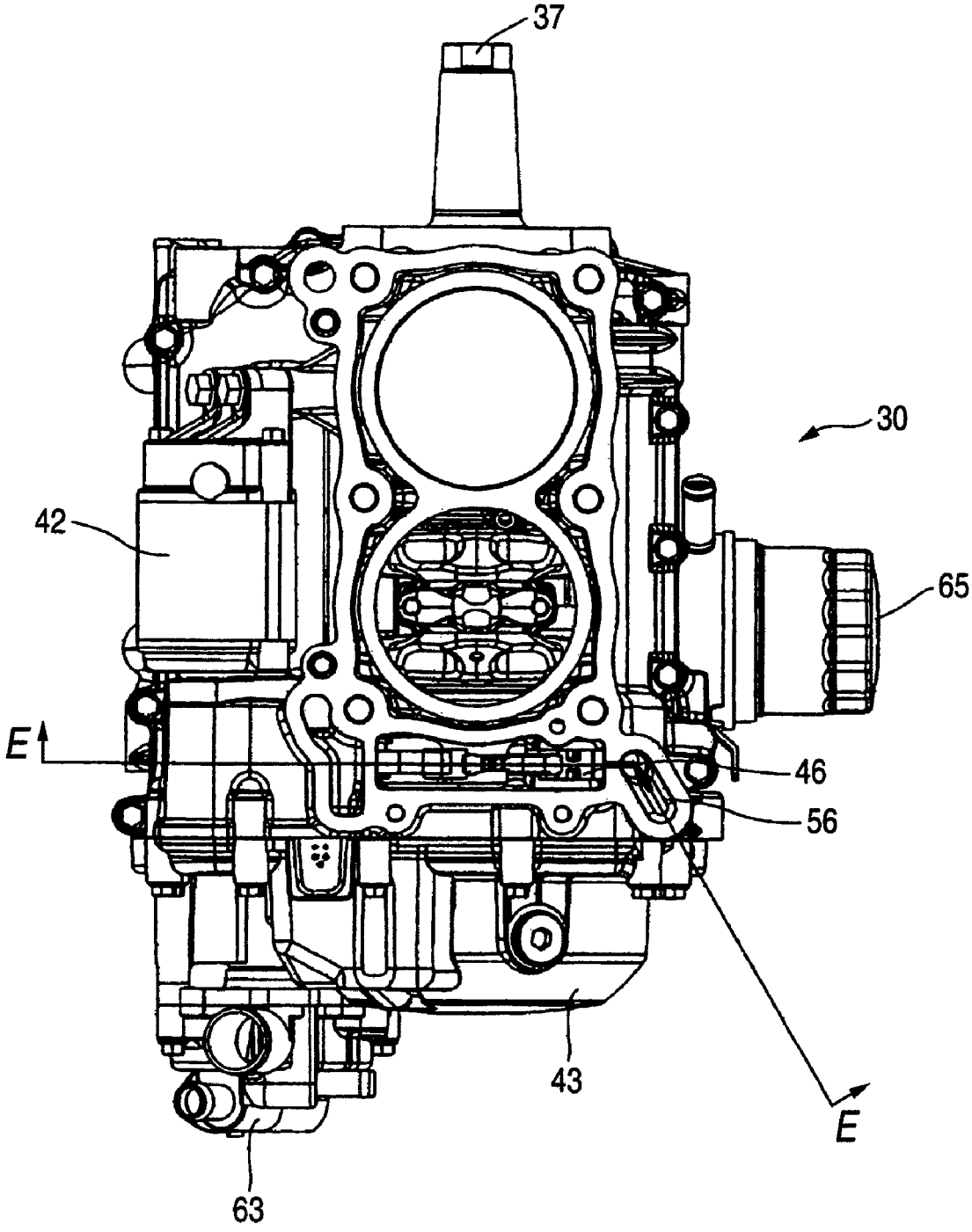
FIG. 5 is a sectional view taken along a line B-B of FIG. 2.
Figure 6:
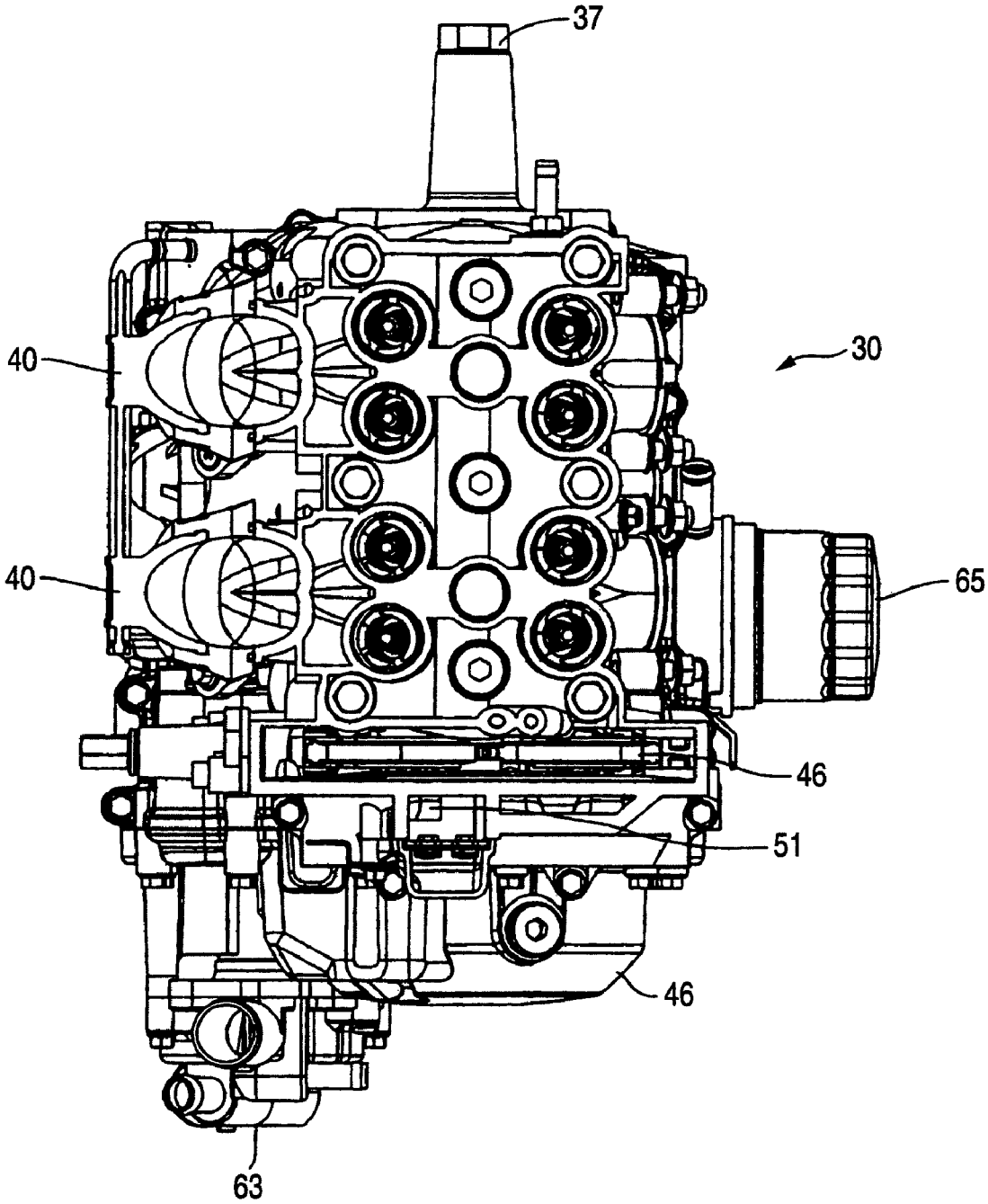
FIG. 6 is a sectional view taken along a line C-C of FIG. 2.
Figure 7:
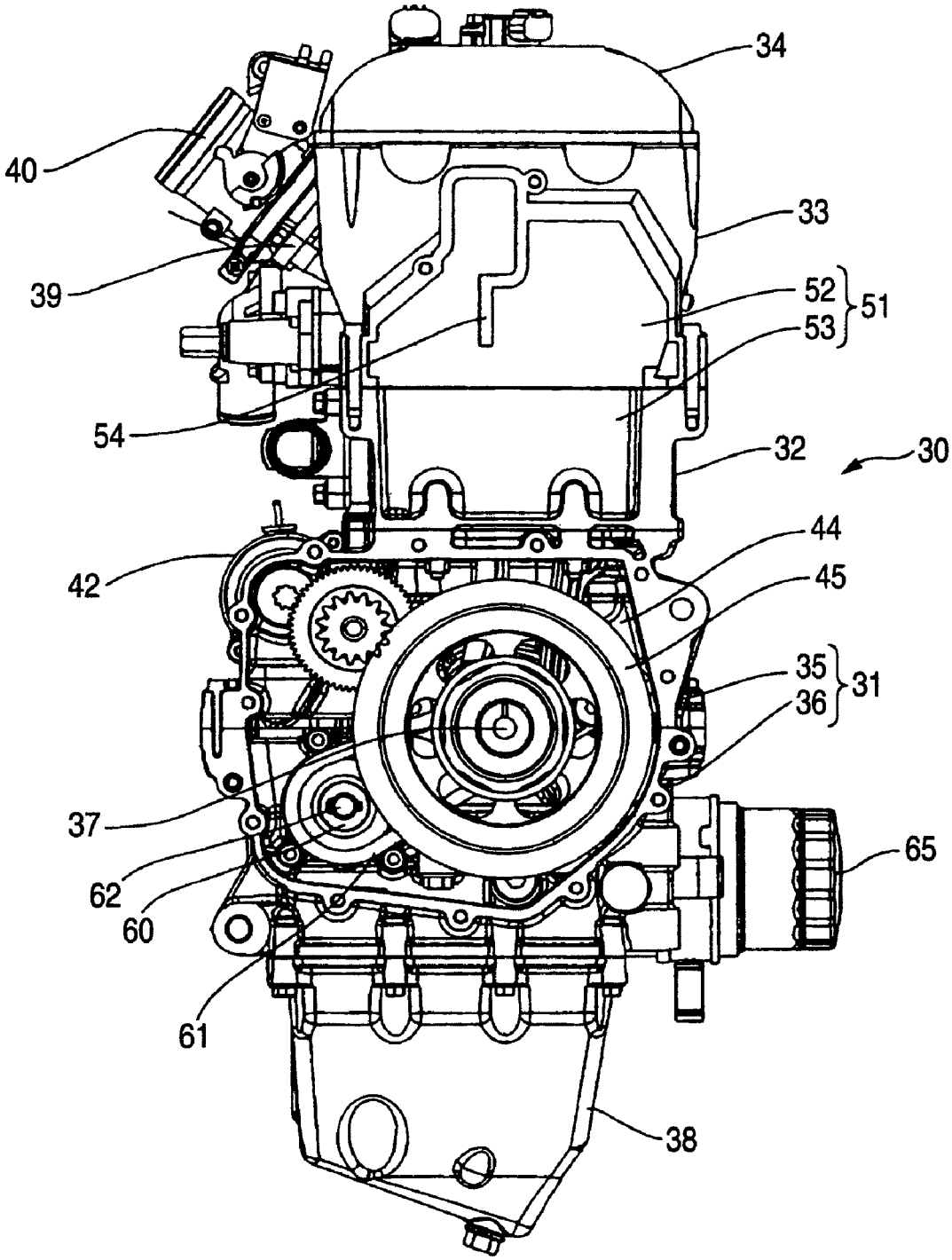
FIG. 7 is a sectional view taken along a line D-D of FIG. 3.
Figure 8:
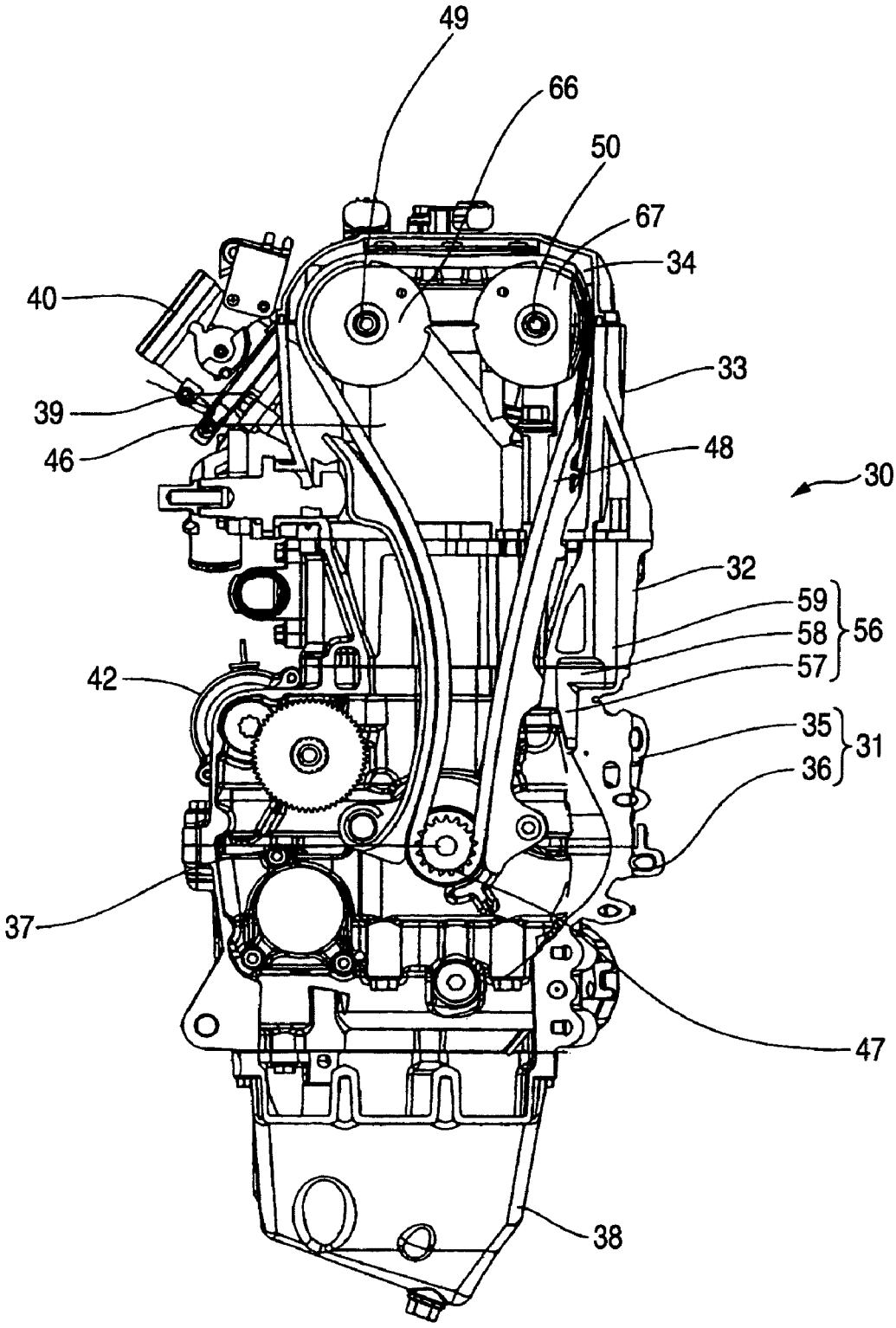
FIG. 8 is a sectional view taken along a line E-E of FIG. 5.

First, the overall configuration of a snow vehicle on which an engine of the embodiment of the invention is mounted will be explained with reference to FIG. 1.

The snow vehicle 1 is formed with a vehicle body frame 10 that extends in a front-back direction. A pair of right and left steering sleds 12 are installed below a front part 11 of the vehicle body frame 10 so as to be rotatable in a right-left direction. Further, a driving crawler 15 is arranged below a rear part 13 of the vehicle body frame 10. The crawler 15 includes a driving wheel 16 arranged at a front end of the rear part 13 of the vehicle body frame 10, a driven wheel 17 arranged at a rear end, a plurality of intermediate wheels 18, a suspension mechanism 19, and a track belt 20 that is wound and circulated around the respective wheels.

A rear portion of the front part 11 of the vehicle body frame 10 forms a shape that rises in an obliquely rearward and upward direction, and a track housing 21 is formed continuously with the rear part 13 of the vehicle body frame 10 so as to accommodate an upper vicinity of the driving wheel 16 of the crawler 15.

The rear part 13 of the vehicle body frame 10 also serves as a cover that accommodates the whole crawler 15 therebelow, a seat 22 is arranged above the rear part 13, and steps (not shown) that become one-step lower than the seat 22 are provided on both sides of the seat 22 in a vehicle width direction.

A steering post 23 is erected in an oblique rearward upward direction from the front part 11 of the vehicle body frame 10, a steering handle 24 is provided at an upper end of the steering post 23 so as to extend in a right-left horizontal direction, and the steering sleds 12 are operated via the steering post 23 by the steering handle 24.

In the vicinity of the steering handle 24, an instrument panel 25 is provided so as to cover a rear upper portion of the front part 11 of the vehicle body frame 10, and instruments, such as a speedometer and a tachometer, are disposed in the instrument panel 25. Further, a windshield 26 is erected in both lateral directions from the front so as to surround a front outer periphery of the instrument panel 25, and an engine hood 27 is formed on the front and lateral sides of a base of the windshield 26 substantially in a streamline shape that is gently downward inclined. Moreover, in the vicinity of an apex of the engine hood 27, a headlight 28 that illuminates the front is disposed.

An engine room 29 is formed below the instrument panel 25 and the engine hood 27 that are disposed in this manner, and an engine 30 is mounted in the engine room 29.

Next, the configuration of the engine of the embodiment of the invention will be explained with reference to FIG. 1 and FIGS. 2 to 8.

The engine 30 is a water-cooled 4-cycle 2-cylinder engine, and the contour thereof is mainly composed of a crankcase 31, a cylinder block 32 connected above the crankcase 31, and a cylinder head 33 and a cylinder cover 34 connected further above the cylinder block 32. The engine is arranged in proximity to the track housing 21 almost in a central portion of the front part of the vehicle body of the snow vehicle 1 in a state where its upper part is tilted rearward of the vehicle body.

The crankcase 31 is configured by a split structure composed of an upper crankcase 35 and a lower crankcase 36, and a crankshaft 37 is supported between the upper crankcase 35 and the lower crankcase 36 in a state where it is substantially parallel to the vehicle width direction. Further, an oil pan 38 is disposed below the lower crankcase 36 in proximity to the bottom of the engine room 29.

An intake passage 39 and a throttle body 40 are disposed behind the cylinder head 33, and the intake passage 39 is arranged in a position higher than the cylinder head 33, and is configured by a down-draft method of blowing down the air sent to an intake port (not shown) from above. Further, an exhaust passage 41 is arranged at a front part of the cylinder head 33, and the exhaust passage 41 is connected to an exhaust muffler that is not shown. Moreover, a starter motor 42 is arranged behind the cylinder block 32 and below the intake passage 39.

The right side of the crankcase 31 is covered with a magnet cover 43, a magnet chamber 44 is formed inside the crankcase, and a right end of the crankshaft 37 is connected to a magnet unit 45.

A cam driving mechanism chamber 46 is provided between the crankcase 31 and a magnet wall 44, and on the right of the engine 30 thereabove, a cam-chain drive sprocket 47 is provided in the cam driving mechanism chamber 46 on the left of the magnet unit 45 at the right end of the crankshaft 37, and the cam-chain drive sprocket 47 is connected to cam sprockets 66 and 67 via a cam chain 48. The cam sprockets 66 and 67 are provided at right ends of cam shafts 49 and 50. Accordingly, the rotation of the crankshaft 37 is transmitted to the cam shafts 49 and 50, and a dynamic valve mechanism (not shown) provided within the cylinder head 33 are operated.

A breather chamber 51 is provided on the right of the cam driving mechanism chamber 46 above the magnet unit 45. The breather chamber 51 is formed by connecting an upper part 52 with which the cylinder head 33 is monolithically formed and a lower part 53 with which the cylinder block 32 is monolithically formed. The upper part 52 of the breather chamber 51 is partitioned into two front and rear chambers by a rib 54 that protrude in a vertical direction, a breather outlet 55 is connected to the rear chamber a reed valve (not shown), and a communication passage 56 that communicates with the cam driving mechanism chamber 46 is open to the front chamber.

The communication passage 56 is formed in a crank shape by a lower vertical passage 57 formed in front of the cam driving mechanism chamber 46, a transverse passage 58 formed in the vicinity of a lower portion of the cylinder block 32, and an upper vertical passage 59 formed in front of the breather chamber 51, and the upper side of the upper vertical passage 59 is open at a matching surface between the cylinder block 32 and the cylinder head 33.

An oil pump 60 is arranged on the rear side and lower side of the crankshaft 37, and the oil pump 60 is driven as the rotation of the crankshaft 37 is transmitted via an oil pump driving chain 61.

A water pump 63 is arranged coaxially with a driving shaft 62 of the oil pump 60, and the water pump 63 is adapted to supply cooling water to a water jacket (not shown) formed inside the engine 30 to cool down the engine 30. Further, a heat exchanger 64 is provided within the engine room 29 so as to face the track belt 20 above (front end of the track housing 21) the front side of the crawler 15 in the traveling direction of a vehicle.

An oil filter 65 is provided in front of the crankshaft 37 so as to protrude forward, and the oil that has passed through the oil filter 65 is supplied to respective part of the engine 30.

A clutch mechanism (not shown) is provided in a left portion of the engine room 29 on the left of the crankshaft 37, and the clutch mechanism is configured as a V-belt-type endless transmission in which a centrifugal clutch device is built, and is configured such that a driving force is transmitted to the track belt 20 via gears or the like on power-receiving side.

In a breather device of an engine for a snow vehicle having such a configuration, the blow-by gas that is generated in a combustion chamber of the engine 30 and has leaked to the cam driving mechanism chamber 46 is led to the breather chamber 51 through the communication passage 56, and then separated into gas and liquid. Then, the gas of the blow-by gas is circulated to an air cleaner (not shown) via the reed valve (not shown) and the breather outlet 55, while the oil is circulated to the oil pan 38 via a return passage (not shown).

According to the breather device of an engine for a snow vehicle according to the embodiment of the invention as described above, the breather chamber 51 is disposed in a dead space on the lateral side of the cam driving mechanism chamber 46 above the magnet unit 45, so that the dead space can be effectively used. Therefore, the total height of the engine 30 can be suppressed low, and the downsizing of the engine 30 can be achieved.

Further, since the breather chamber 51 is formed by connecting the upper part 52 with which the cylinder head 33 is monolithically formed and the lower part 53 with which the cylinder block 32 is monolithically formed, it is possible to reduce the number of parts and to streamline an assembling process of the breather chamber. At the same time, the volume of the breather chamber 51 can be sufficiently secured.

Further, since the communication passage 56 is formed in the crank shape between the breather chamber 51 and the cam driving mechanism chamber 46, even if the snow vehicle is overturned, most of oil flows toward the cylinder head 33, and hardly flows into the communication passage 56. Moreover, for example, even if oil flows into the breather chamber 51, since the breather chamber 51 is partitioned into two chambers by the rib 54, there is no fear that the oil leaks from the breather outlet 55.

Furthermore, since the breather chamber 51 is disposed on the lateral side of the engine 30, the breather chamber 51 is warmed by the heat transfer from the cylinder head 33 or cylinder block 32. Accordingly, there is no fear that the moisture inside the breather chamber 51 or communication passage 56 is cooled down and frozen by the wind during traveling, and the reliability of the breather device can be enhanced.

In addition, the breather chamber 51 may be formed by monolithically forming a rib constituting an outer peripheral wall of the breather chamber 51, on the external surfaces of the cylinder head 33 and cylinder block 32, and attaching a separately formed cover member on the lateral surface thereof. In this case, the cover member is preferably formed monolithically with the magnet cover 43.

Further, in the above embodiment, the aforementioned breather device is applied to an engine of a snow vehicle. However, the invention is not limited to this case. For example, it is natural that the invention can be applied to engines of vehicles, such as two-wheeled motor cycles and ATV (All Terrain Vehicle), other than the snow vehicle.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A breather device provided in a 4-cycle engine which is configured to be mounted on a front part of a vehicle body of a snow vehicle, the breather device comprising:

a breather chamber integrally provided on a lateral side of the 4-cycle engine, wherein the 4-cycle engine includes a crankcase, a cylinder block coupled to an upper part of the crankcase, and a cylinder head coupled to an upper part of the cylinder block, wherein a cam driving mechanism chamber is provided on the lateral side of the 4-cycle engine, wherein the breather chamber is provided on a lateral side of the cam driving mechanism chamber, wherein the breather chamber includes an upper part monolithically integrated with the cylinder head, and a lower part monolithically integrated with the cylinder block, wherein the upper part of the breather chamber is partitioned into two chambers by a rib extending in a vertical direction, wherein one of the chambers is provided with a communication passage communicating with the cam driving mechanism chamber, and wherein another of the chambers is provided with a breather outlet.

2. The breather device as set forth in claim 1, wherein the communication passage includes an upper vertical passage communicated with the breather chamber, a lower vertical passage communicated with the cam driving mechanism chamber, and a transverse passage connecting the upper vertical passage with the lower vertical passage, thereby being formed into a crank shape.

* * * * *